US008640288B2

(12) United States Patent
Jensen et al.

(10) Patent No.: US 8,640,288 B2
(45) Date of Patent: Feb. 4, 2014

(54) DISPOSABLE TRANSPORTER

(75) Inventors: Ronald Jensen, Chicago, IL (US); Richard Beu, Yorba Linda, CA (US); Sayandro Versteylen, Ontario, CA (US)

(73) Assignee: Paper-Pak Industries, Laverne, CA (US)

( * ) Notice: Subject to any disclaimer, the term of this patent is extended or adjusted under 35 U.S.C. 154(b) by 619 days.

(21) Appl. No.: 12/449,706

(22) PCT Filed: Mar. 5, 2008

(86) PCT No.: PCT/US2008/002907

§ 371 (c)(1), (2), (4) Date: Aug. 21, 2009

(87) PCT Pub. No.: WO2008/109099

PCT Pub. Date: Sep. 12, 2008

(65) Prior Publication Data

US 2010/0011506 A1 Jan. 21, 2010

Related U.S. Application Data

(60) Provisional application No. 60/893,112, filed on Mar. 5, 2007.

(51) Int. Cl.
*A61G 1/013* (2006.01)
*A61G 1/00* (2006.01)

(52) U.S. Cl.
USPC ..... 5/625; 5/626; 5/627

(58) Field of Classification Search
USPC ..... 5/620, 621, 625–628, 89.1; 224/158, 224/18, 157; 294/151, 152; 128/870; 27/28
See application file for complete search history.

(56) References Cited

U.S. PATENT DOCUMENTS

| | | | | | |
|---|---|---|---|---|---|
| 722,456 | A | * | 3/1903 | Reeves | 5/627 |
| 2,385,067 | A | * | 9/1945 | Egardner | 5/627 |
| 2,788,530 | A | * | 4/1957 | Ferguson | 5/628 |
| 4,124,908 | A | * | 11/1978 | Burns et al. | 5/628 |
| 4,790,051 | A | * | 12/1988 | Knight | 27/28 |
| 4,961,982 | A | | 10/1990 | Taylor | 428/41 |
| 5,121,514 | A | * | 6/1992 | Rosane | 5/628 |
| 5,476,456 | A | | 12/1995 | Rankin et al. | 604/358 |
| 5,659,933 | A | | 8/1997 | McWilliams | 27/28 |
| 5,699,568 | A | | 12/1997 | Couldridge | 5/628 |
| 5,720,303 | A | * | 2/1998 | Richardson | 128/870 |
| 5,839,137 | A | * | 11/1998 | Butler et al. | 5/627 |

(Continued)

OTHER PUBLICATIONS

International Search Report dated Jun. 10, 2008 for the corresponding PCT/US2008/109099.

(Continued)

*Primary Examiner* — Michael Trettel
(74) *Attorney, Agent, or Firm* — Ohlandt, Greeley, Ruggiero & Perle, LLP

(57) ABSTRACT

The present disclosure is a disposable transporter that is absorbent, portable, and lightweight, and having sufficient strength to carry an injured soldier or medical patient. The transporter has a backing substrate, absorbent body, and gripping device. The gripping device permits manual carrying or insertion of poles to form a litter or portable cot. The absorbent body may have active agents that kill microorganisms to reduce the risk of contamination, infection, and odors from blood or other body fluids. The disclosure provides a process for producing base materials for the transporter. Also disclosed is a transporter kit having a transporter and a water-resistant case.

19 Claims, 11 Drawing Sheets

(56) References Cited

U.S. PATENT DOCUMENTS

| | | | | |
|---|---|---|---|---|
| 6,199,232 | B1 * | 3/2001 | Kocivar | 5/502 |
| 6,874,176 | B2 * | 4/2005 | Berge | 5/81.1 T |
| 2005/0051203 | A1 * | 3/2005 | McCully et al. | 135/87 |

OTHER PUBLICATIONS

Official Action dated Mar. 22, 2013 for corresponding Mexican Patent Application No. MX/a/2009/009249 with English translation (6 pages).

* cited by examiner

DISPOSABLE TRANSPORTER

CROSS-REFERENCE TO RELATED APPLICATIONS

This application is the National Stage of International Application No. PCT/US2008/002907, filed on Mar. 5, 2008, which claims the benefit of U.S. Provisional Application No. 60/893,112, filed on Mar. 5, 2007, which are incorporated herein by reference.

BACKGROUND OF INVENTION

1. Field of Invention

The present disclosure relates to a disposable transporter for carrying an injured or ill soldier or medical patient that is portable, absorbent, and lightweight. More particularly, the present disclosure relates to such a disposable transporter that has an absorbent body, which absorbent body may contain antimicrobial agents or other active agents to reduce contamination and odors. The transporter can be part of a kit that also includes a water-resistant/weather-resistant case.

2. Description of the Related Art

Pieces of heavy cloth, such as canvas or similar materials, and leather attached to wood or metal poles have long been used as litters or stretchers for transporting injured soldiers and patients in emergency situations. In medical settings, litters and stretchers are used to transfer patients from the home or injury site to an ambulance. Litters are also used to transfer patients to and from their beds to a wheeled gurney for transport to other areas within the medical center.

A problem with conventional litters for military use is that, for a litter that is large and strong enough to carry a soldier's weight, the litter itself can be too heavy for a soldier to carry onto the battlefield, and the combination of litter and wounded soldier too heavy and unmanageable to quickly carry or drag from the battlefield to medical care. In addition, a wounded soldier may be bleeding or involuntarily releasing other body fluids onto the litter, thereby contaminating or infecting the litter for himself and for any other soldiers who will be subsequently carried on the litter. Absorbed fluids add to the weight of the litter and may weaken its integrity on future carries. Also, blood and other fluids may make the surface of the litter slippery, increasing the risk that the person may fall off of the litter while being carried, particularly when moved quickly over difficult terrain in battlefield conditions or in harsh weather.

There exists a need for a disposable transporter to carry an injured soldier or patient that is lightweight, portable, and absorbent, with sufficient ruggedness and strength to safely carry a soldier or patient to safely carry a soldier or patient to medical care. In addition, such transporter should be able to be folded to a reduced size for portability and easy storage when not in use, but large enough when opened to comfortably transport a full-size adult. There also exists a need for such transporter that has a capability to absorb large amounts of blood and other body fluids from the soldier or patient being carried to reduce the risk of contamination, without compromising the integrity of the transporter.

SUMMARY OF THE INVENTION

The present disclosure provides a disposable transporter for carrying an injured or ill soldier or medical patient that is lightweight, absorbent, and portable.

The present disclosure also provides for such a transporter that has a backing substrate, an absorbent body on the backing substrate, and a gripping device that passes through, or is attached to, the backing substrate.

The present disclosure further provides such a transporter that has a gripping device that can be holes, cutouts, or straps that can be used to manually lift and carry the transporter, or to insert rigid structures, such as poles, to carry the transporter.

The present disclosure still further provides that such a transporter may have active agents, such as antimicrobials, to kill microorganisms and reduce the risk of contamination by blood-borne pathogens, reduce or eliminate odors, as well as simplify the steps to dispose of soiled or contaminated transporters. Such active agents may also reduce the risk of development of bedsores and other skin conditions.

The present disclosure also provides a process for preparing the materials used as the base materials for the transporter.

The present disclosure further provides a kit including the transporter and a water-resistant/weather resistant case is also provided.

These and other advantages and benefits are achieved by the present disclosure that comprises a transporter that is absorbent, portable, lightweight, and disposable.

DETAILED DESCRIPTION OF THE INVENTION

Figure 1:
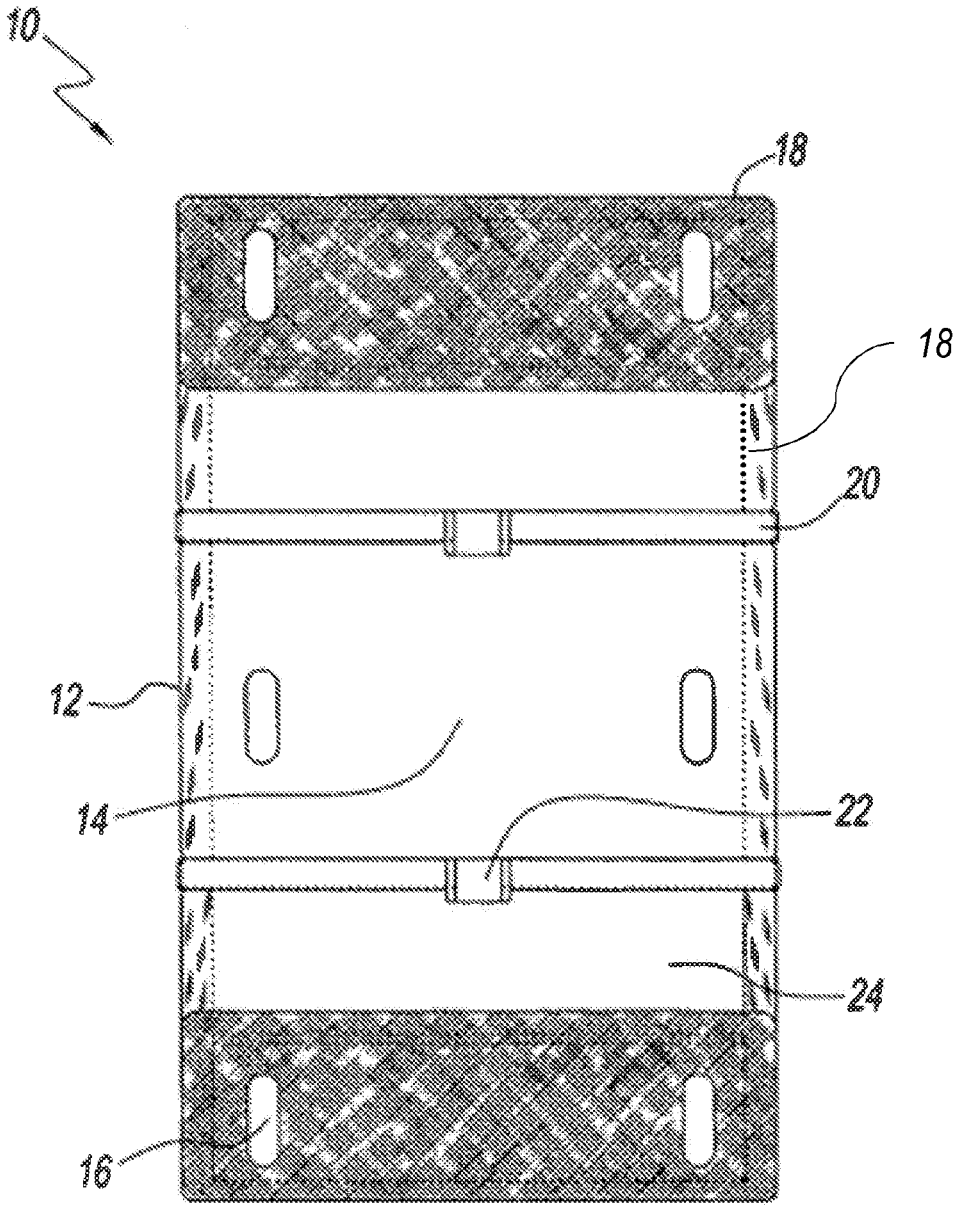
FIG. 1 is a plan view of a transporter of the present disclosure.

Referring to the drawings and, in particular, FIG. 1, there is provided a disposable transporter generally represented by reference numeral 10. Transporter 10 has a backing substrate 12. Backing substrate 12 has an absorbent body 14 positioned thereon. Transporter 10 has one or more gripping devices 16 positioned at the ends and/or along the sides of transporter 10. In the embodiments shown in the figures, gripping devices 16 are cut through backing substrate 12 and/or absorbent body 14. Transporter 10 has a binder 18 that is attached along a long edge of the transporter. Transporter 10 can have one or more securing straps 20 that extend across the width of transporter 10, with tension-adjusting devices 22, such as buckles. The embodiment of transporter 10 in FIG. 1 has one or more flat panels 24.

Transporter 10 is a lightweight, portable, absorbent device for carrying or transporting a person, such as an injured soldier or a patient in a medical care center, such as a hospital or nursing home. When not in use, transporter 10 can be folded to a compact size to be easily carried by a person or stored for later use in itself, or as part of a kit. After one or more uses, transporter 10 may be disposed of.

Transporter 10 is lightweight in construction. The weight of transporter 10 is less than about 150 grams/meter$^2$. The outer dimensions of transporter 10, when opened to its full size, are at least eighteen (18) inches wide and at least sixty-five (65) inches long, such that a soldier or patient can be carried thereon. In an exemplary embodiment, transporter 10 is about seventy-eight (78) inches in length and about thirty-three-and-a-half (33.5) inches in width, and weighs less than four (4) pounds, and preferably weighs less than 3 pounds.

Transporter 10 is able to carry a person weighing at least 250 pounds. Transporter 10 is preferably able to carry a person weighing at least 300 pounds, and more preferably a person weighing at least 350 pounds. Transporter 10 provides a strong, rugged means to carry an injured or ill person that is lightweight and portable.

As used herein, the terms "carry" and "transport" are used interchangeably.

Backing substrate 12 (shown in FIG. 1) forms the back portion of transporter 10. Backing substrate 12 preferably covers the entire back surface of transporter 10 and extends beyond the length of absorbent body 14 and is folded over to form a portion of the top surface of transporter 10. Backing substrate 12 thus forms a top edge and a bottom edge of transporter 10. When folded over to form a portion of the top surface of transporter 10, backing substrate 12 extends a distance of at least one (1) inch to about one-quarter of the total length of the top side of transporter 10. Backing substrate 12 preferably covers the back portion of absorbent body 14. Backing substrate 12 is secured in position by thread, adhesive, or other fasteners (for example, by hook and loop fasteners that are commercially available as VELCRO®, Velcro Industries B.V. LLC Netherlands, Curacao, Netherlands Antilles). Backing substrate 12 is preferably adhered to or fastened to the top of transporter 10 by sewing across the width of transporter 10.

Backing substrate 12 is made of material that is liquid-resistant or liquid-impervious. Backing substrate 12 is made of material that includes, but is not limited to, nylon, nylon composite material, strong cloth material, canvas, hemp, flax, cotton fiber materials, polyethylene, polypropylene, polymer films, or any combinations thereof. An embodiment of backing substrate 12 is made of nylon material. Another embodiment of backing substrate 12 is made of cotton or canvas material. Another embodiment of backing substrate 12 is made of polyethylene and/or polypropylene films. Backing substrate 12 provides durability, strength, weather-resistance, and ruggedness to transporter 10. Backing substrate 12 is preferably made of material that is puncture-resistant. Puncture resistance is particularly useful for those embodiments of transporter 10 likely to be used to carry an injured person over rugged terrain or rough surfaces, especially where a single person is effecting a rescue and carry, and must drag transporter 10 and the injured person over the terrain. For example, backing substrate 12 made of polyethylene provides a wind barrier and moisture barrier that protects and secures the person being carried on transporter 10.

Backing substrate 12 may have colors and/or patterns that facilitate military and civilian applications of transporter 10. Such colors and/or patterns include, but are not limited to, black, white, khaki and/or camouflage.

Backing substrate 12 may also have one or more access slits passing through the back surface and/or top surface of transporter 10, to provide complete access for medical personnel to the person being transported and also to provide points of passage for tubes needed to treat the soldier or patient. Such slits are closeable, and provide a seal around anything passing through the openings of the access slits. Closures for access slits may be any closure means, such as hook and loop fasteners that are commercially available as VELCRO®, Velcro Industries B.V. LLC Netherlands, Curacao, Netherlands Antilles.

Absorbent body 14 is an absorbent material or superabsorbent material that is suitable for absorbing large amounts of fluids. Examples of absorbent and superabsorbent materials that can be used for absorbent body 14 include, but are not limited to, an airlaid, an airlaid composite, fluff pulp, bonding fiber, superabsorbent polymer (SAP), compressed SAP composite of SAP polymer granules adhered with one or more binders and/or plasticizers, compressed composite containing a percentage of short or microfiber materials, thermoplastic polymer fibers, thermoplastic polymer granules, cellulose powders, cellulose gels, an airlaid with SAP, a fibrous or foam structure that has been coated or impregnated with a SAP, an absorbent structure having one or more starch or cellulose based absorbents or containing superabsorbent material formed and/or crosslinked, or any combinations thereof. Superabsorbent materials used in the present disclosure can be used in various forms that include, but are not limited to, granular, fiber, liquid, superabsorbent hot melts, or any combinations thereof. An embodiment of the present disclosure has a top surface or layer of absorbent body 14 that is made of a polymer film, such as polyethylene or polypropylene film. Another embodiment has a top surface of absorbent body 14 that is made of a non-woven material, such as airlaid formed on a non-woven material. Another embodiment of absorbent body 14 is made of a cotton fiber substrate, and/or cotton fibers within another matrix structure.

Absorbent body 14 and/or backing substrate 12 may each have a top surface that is made of a non-slip material, or treated with a non-slip agent, to reduce movement or slipping of a soldier or patient who is being carried on transporter 10, particularly when transporter 10 becomes wet from use in rain or snow, or from exuded blood or body fluids. As used herein, a "non-slip" surface indicates that the surface has a larger Coefficient of Friction than a corresponding surface without non-slip properties. The use of non-slip materials for the top layer of absorbent body can reduce patient sliding and movement on top of transporter 10 during transport, adding to the sense of security and well-being for the person being carried.

Absorbent body 14 and/or backing substrate 12 may also contain an active agent that is one or more antimicrobial agent, bactericide, fungicide, virucide, disinfectant, sanitizer, sterilizer, mildewstat, surfactant, deodorizer, or any combinations thereof. The active agent may be a solid, liquid or gas. The active agent may be disposed on the surface of and/or within the absorbent body 14 or backing substrate 12. In the embodiment illustrated in FIG. 11, the active agent 50 is in two absorbent layers 46, 48 of absorbent body 14. The presence of one or more active agents in absorbent body 14 has the benefit of reducing or eliminating the risk of contagion from blood-borne pathogens. Such an active agent in absorbent body 14 also reduces the risk of development of bedsores and other skin conditions that can result from, or be exacerbated by, contact of a patient's skin with wet and/or contaminated surfaces.

Examples of an active agent include, but are not limited to, metal, metal compound, surface active agent, quaternary ammonium compound, organic acid, inorganic acid, salt, sulfite, biopolymer, synthetic polymer, chitin, chitosan, nisin, enzyme, arginate, diacetate, antioxidant, or any combinations thereof.

The active agent in absorbent body 14 may be added to absorbent body 14 or backing substrate 12 in its active form, or, alternatively, in an inactive form that becomes activated upon contact with moisture or fluids.

Absorbent body 14 may also contain, or be treated with, a surfactant that enhances absorption of fluids by absorbent body 14. Examples of surfactants that can be used in the present disclosure include anionic surfactants, cationic surfactants, zwitterionic surfactants, and non-ionic surfactants.

Absorbent body 14 may have one or more strengthening layers to improve the strength and/or resistance to tearing of absorbent body 14. The one or more strengthening layers can be located on top of, below, or in between any portion of absorbent body 14. A strengthening layer for absorbent body 14 may be made of standard non-woven material, or melt-blown or spunlace composites. An exemplary embodiment is a polypropylene non-woven or polypropylene/meltblown non-woven material.

Binder 18 is positioned and attached along a long edge of transporter 10 to overlay a small portion of absorbent body 14 and the backing substrate. Binder 18 provides a defined edge to transporter 10 and reinforces the integrity and shape of the transporter when in use. Binder 18 can be made of a webbing material such as polyester or polypropylene. Binder 18 may be attached to transporter 10 with thread, adhesive, and/or other attachment means or fastener (for example, hook-and-loop fasteners commercially available as VELCRO®, Velcro Industries B.V. LLC Netherlands, Curacao, Netherlands Antilles). Binder 18 can be attached onto the edge of transporter 10 extending from the edge to a width that is between about one-quarter (¼) inch to about 2 inches, with a preferred width from the edge that is about 1.25 inches along a long edge of transporter 10. "About," as used in this application, means plus or minus 0.25 inches. Binder 18 provides additional integrity to transporter 10, and makes transporter 10 finished in appearance.

As shown in the embodiment in FIG. 1, securing straps 20 and tension-adjusting buckles 22 can be used to secure patients or soldiers to transporter 10. Securing straps 20 are positioned to extend across the width of transporter 10. The ends of securing straps 20 are folded under to a length of about 1.5 inches to about 4.5 inches beneath transporter 10. A preferred embodiment of the present disclosure has one or more securing straps each folded under transporter 10 for about 3.0 inches to about 4.5 inches, and more preferably folded 4 inches under transporter 10. There may be from zero to seven securing straps 20 on transporter 10. In some exemplary embodiments, there are two to four securing straps 20. Securing straps 20 can be made of cloth, canvas, nylon, nylon-based material, or synthetic materials. Securing strap 20 can be attached to transporter 10 either above or beneath binder 18. A preferred embodiment has securing strap 20 attached to transporter 10 beneath binder 18. Each securing strap 20 may also have one or more tension-adjusting device, such as a buckle 22, to further secure a person being carried on transporter 10. The straps and buckles help secure the person being carried to the transporter, reducing the likelihood that the person being carried will slip to one side of, or even off of, transporter 10.

One or more gripping devices 16 are positioned anywhere along the perimeter structure of transporter 10, such as at the edges and/or along the sides of the transporter. The one or more gripping devices 16 are preferably positioned symmetrically along the ends and/or along the sides of transporter 10. Gripping device 16 may be a hole that passes through backing substrate 12, a strap or eyelet loop that is attached to backing substrate 12, or combinations thereof. Gripping device 16 permits manual gripping and lifting by a person serving as a carrier of transporter 10. Gripping device 16 also permits insertion of one or more rigid structures, such as poles, or any combinations of these, to enhance the ease of carrying transporter 10 as a litter with a person thereon. The present disclosure provides a plurality of gripping devices 16. Transporter 10 may have one to ten gripping devices 16 positioned at any location in transporter 10. A preferred embodiment of transporter 10 has four to eight gripping devices 16 that are positioned symmetrically or asymmetrically around the perimeter of transporter 10.

Figure 5:
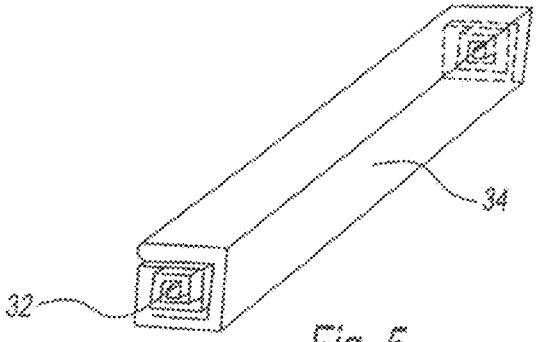
FIG. 5 is a perspective view of the transporter of FIG. 1 folded in a flat-over roll configuration.

Transporter 10 may have one or more flat panels 24. An embodiment of a transporter 10 having flat panels 24 is provided in FIG. 1. Flat panels 24 provide additional strength to transporter 10 and permit greater ease in folding the transporter. Various folding configurations may be used for transporter 10, such as a "flat-over roll" configuration (as shown in FIG. 5), or "accordion" folding configuration, to reduce the size of transporter 10 when not in use and thereby enhance portability.

Figure 2:
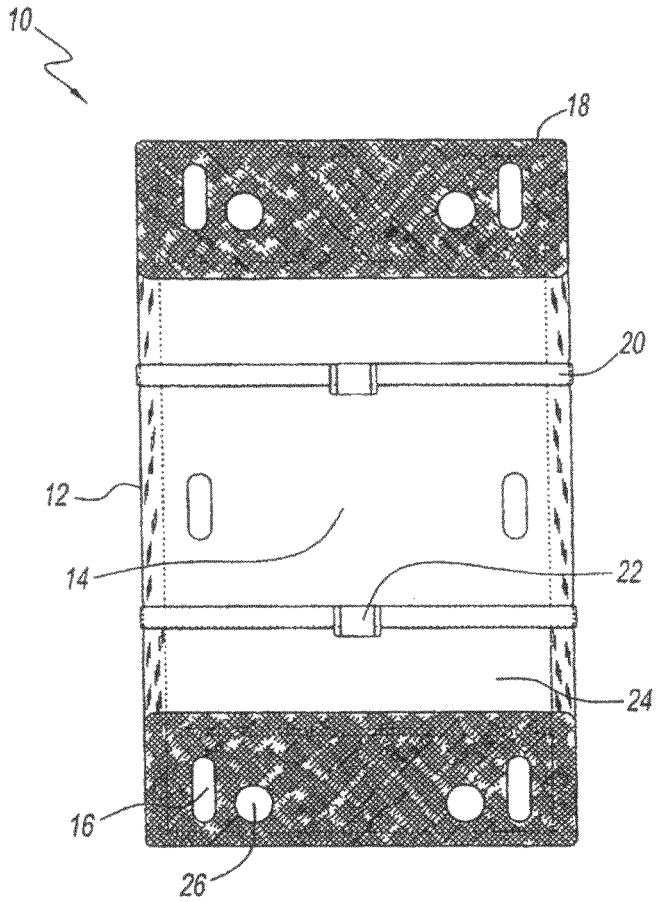
FIG. 2 is a plan view illustrating an embodiment having circular cutouts on each end of the transporter of FIG. 1.

FIG. 2 illustrates an embodiment of transporter 10 having circular cutouts 26 that serve as additional gripping devices 16, or as slots through which rigid structures 28 can be inserted.

Figure 3:
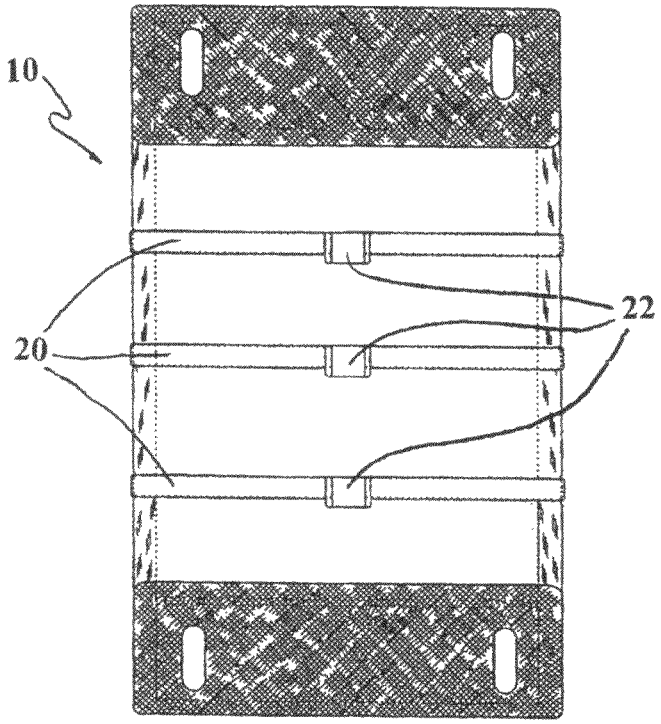
FIG. 3 is a plan view of another embodiment having three securing straps of the transporter of FIG. 1.

FIG. 3 illustrates an embodiment of transporter 10 having three securing straps 20 and buckles 22 to secure the person being carried thereon.

Figure 4:
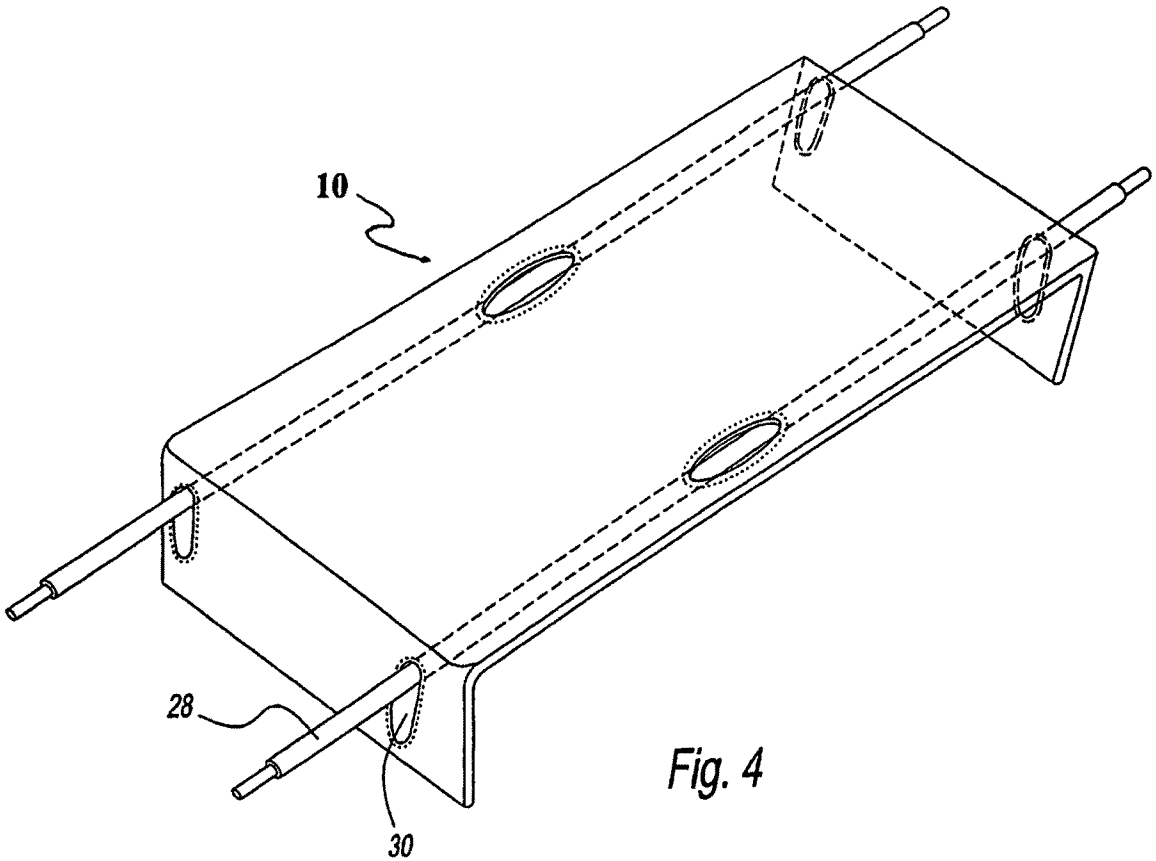
FIG. 4 is a perspective view of the transporter of FIG. 1 illustrating an embodiment having rigid bodies (telescoping poles) inserted.

Referring to FIG. 4, transporter 10 of the present disclosure may include a rigid body 28 that is passed through one or more gripping device 16. Rigid bodies 28 can be any solid or hollow body that can be passed through gripping device 16. Rigid bodies 28 are preferably made of metal, polymers, or wood. A rigid body 28 of the present disclosure is preferably in the form of pole. As an example, rigid body 28 can be a hollow polyvinyl chloride pole. Rigid bodies 28 can be solid or hollow structures, depending on the need for strength and reduced weight. The cross-section of a rigid body 28 may be any shape, with preferred embodiments having round, ovate, or flat cross-sections. As shown in the embodiment in FIG. 4, a rigid body 28 can have a "telescoping" configuration to enhance portability when not in use, where "telescoping" means that certain sections of rigid bodies 28 are sized to pass inside another section, in the manner of a telescope. Additional rigid bodies 28 can also be attached at other locations within, or under, the surface of transporter 10, in any direction. FIG. 4 illustrates an embodiment of transporter 10 with two telescoping rigid bodies 28 that are metal poles inserted through certain gripping devices 16. This configuration enables transporter 10 to be carried more easily by two or more persons acting as carriers. Also, this structure provides additional support for the integrity of transporter 10 and, moreover, anatomic support for a person carried on the transporter.

Referring to FIG. 5, transporter 10 is foldable into a flat roll as shown in configuration 32. This configuration reduces the size of transporter 10 when the transporter is not in use, thus enhancing portability, and minimizing storage space. Transporter 10 is preferably able to be folded more than one time. In this flat-roll configuration 32, each flat panel 24 is folded in the same direction so that the outer side of the roll forms an unbroken surface 34. However, other folding configurations for transporter 10 may also be used to reduce storage size, such as an "accordion" or "map" folding configuration, where each flat panel 24 of transporter 10 is folded in alternating directions.

Figure 6:
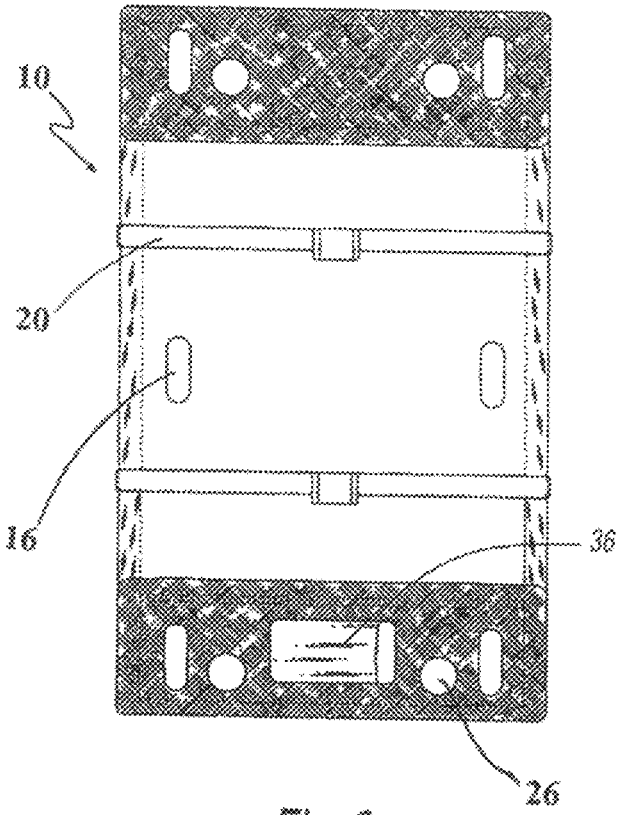
FIG. 6 is a plan view of FIG. 2 illustrating an embodiment of a transporter having a pouch.

FIG. 6 illustrates an embodiment of transporter 10 having one or more pouches 36 that are positioned on the perimeter sections on one or both ends of transporter 10, gripping devices 16, and circular cutouts 26. As illustrated in FIG. 6, pouch 36 is positioned on the perimeter section at one end of transporter 10. The one or more pouches 36 may be used to carry medical supplies or medications, patient information and medical charts, or the patient's or soldier's personal clothing or property.

Figure 7:
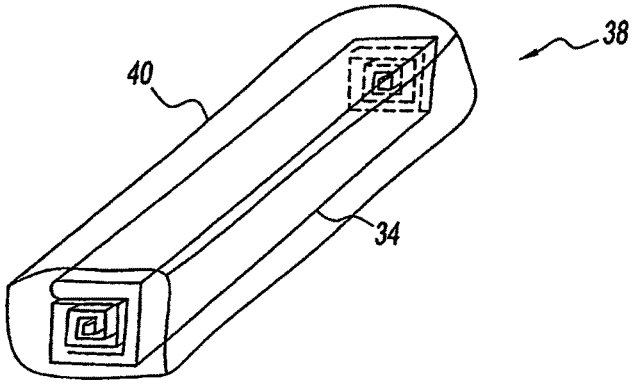
FIG. 7 is a perspective view of a kit with the transporter of FIG. 5 enclosed in a water-resistant case.

FIG. 7 illustrates kit 38, having a water-resistant case 40 enclosing the transporter. The transporter can be folded within case 40 to enhance portability. The water-resistant case 40 can be closed and/or sealed. Once sealed, case 40 may have some or all of the air evacuated by vacuum or negative pressure, to reduce the size of the kit, enhance portability, and reduce the likelihood of contamination or absorption of moisture by the absorbent body prior to use. Preferably, the transporter is folded in flat roll configuration 32 or in accordion configuration before being enclosed by water-resistant case 40.

Figure 8:
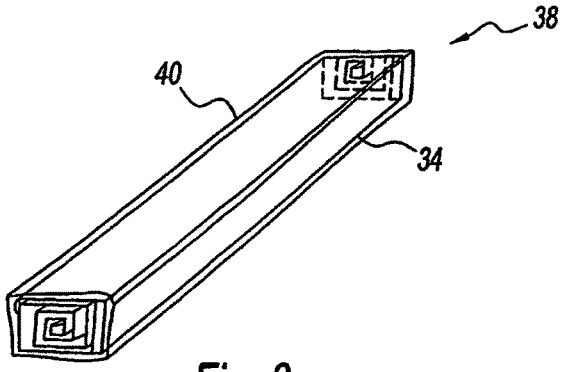
FIG. 8 is a perspective view illustrating a kit of FIG. 7 that is sealed and compressed by evacuating air from within the water-resistant case.

Referring to FIG. 8, kit 38 is shown in compressed configuration, after case 40 is closed and sealed and some or all of the air inside case 40 has been removed by vacuum. Removing air within case 40 shrinks the overall size and weight of kit 38, thereby further improving the portability of kit 38, and reducing storage space. The volume of kit 38, under vacuum, is preferably less than about 0.030 $m^3$, and more preferably less than about 0.020 $m^3$, where each volume is plus or minus 0.01 $m^3$.

In an embodiment of the present disclosure, the transporter is folded and placed in vacuum-sealed cases having approximate dimensions of 17 inches width×23 inches length×3 inches height, which corresponds to a volume of about 0.019 $m^3$. The folded dimensions of transporter 10 are preferably from about 10 inches to about 24 inches width, about 16 inches to about 36 inches length, and about 1 inch to about 10 inches height.

Figure 9:
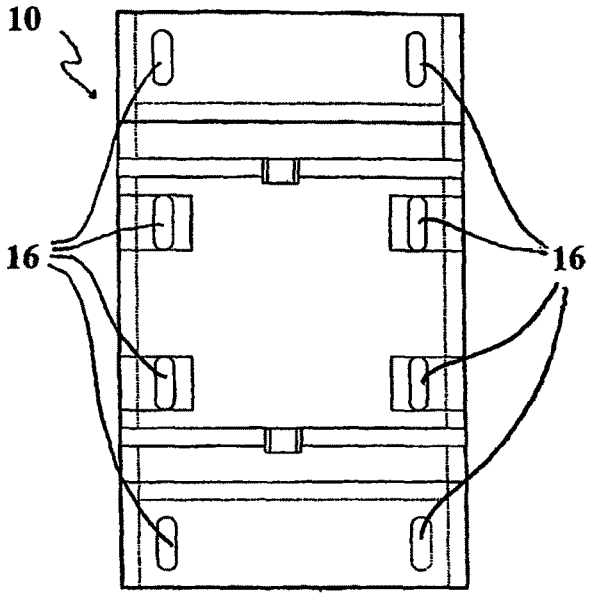
FIG. 9 is a plan view of a transporter having four gripping devices on each side of the transporter of FIG. 1 (totaling eight gripping devices).

Referring to FIG. 9, a preferred embodiment is shown having eight gripping devices 16 that are symmetrically positioned as four gripping devices along on each long side of transporter 10.

Figure 10:
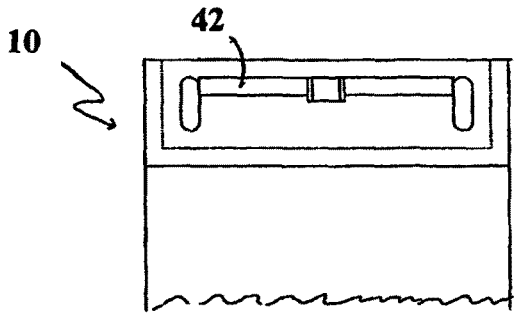
FIG. 10 is a plan view (cut away) of the back portion of the transporter, illustrating a strap added across the top of the back of the transporter, permitting the transporter to be secured to a carrying system in a vehicle.

Referring to FIG. 10, which is a cut away view of the underside of the transporter, a strap 42 is shown. Strap 42 may be one or more straps. Each end of strap 42 is folded to the top side of transporter 10 by one (1) inch to two (2) inches in order to permit sewing or other adherence of strap 42 to transporter 10. Strap 42 may be used to help secure transporter 10 into fixed rack systems of a transport vehicle, such as an ambulance or helicopter. For example, strap 42 may be used to help secure transporter 10 to a typical TALON-type litter for security during transport, and to prevent blowing during helicopter evacuations and windy conditions.

Figure 11:
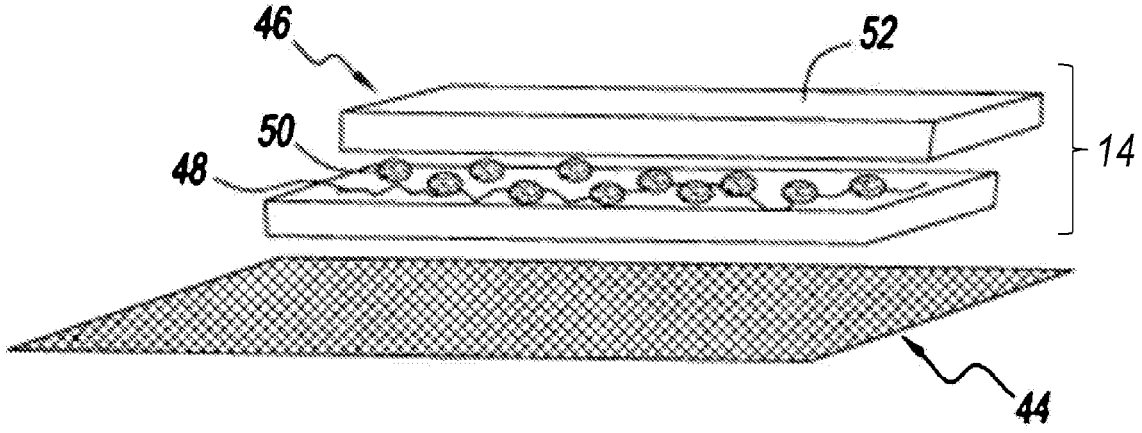
FIG. 11 is a schematic illustrating an embodiment where an active agent is disposed on and between layers of an absorbent body in the transporter of FIG. 1.

FIG. 11 illustrates an embodiment of absorbent body 14, where the active agent is an antimicrobial compound 50 that is disposed between two or more composite layers 46, 48 within absorbent body 14. Although FIG. 11 illustrates an absorbent body with two layers, more absorbent layers may be used in other embodiments of absorbent body 14. Non-woven cover stock 52 is covering the top of each layer. A backing substrate 44, made of a material such as polyethylene, can be sized for the product being produced.

Figure 12:
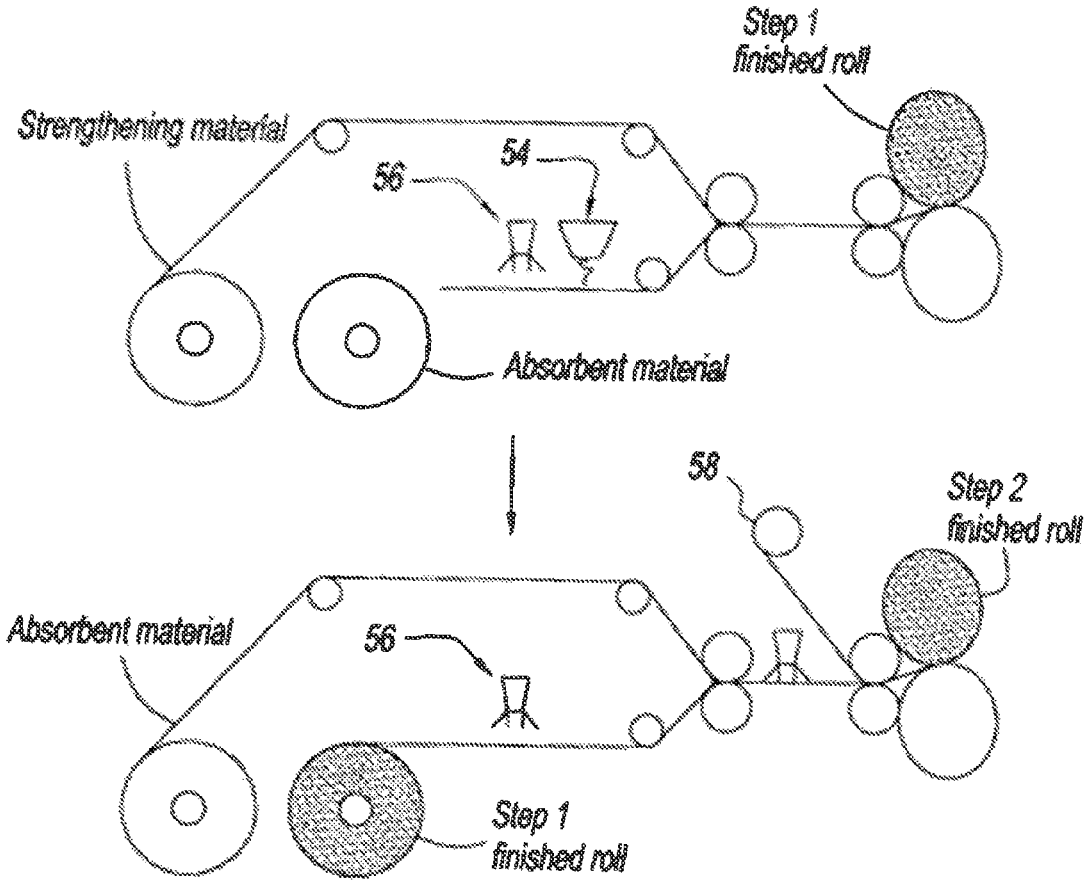
FIG. 12 is a schematic of a process flow to make the base materials of the transporter of FIG. 1, where an antimicrobial in the absorbent body is a powder.

Referring to FIG. 12, a schematic of a process flow to produce the base materials used in transporter 10 is illustrated. FIG. 12 illustrates the process to combine an aspect of the absorbent core, strengthening material, and an antimicrobial powder. In the first step shown, a piece of absorbent material is unwound, and hot melt adhesive 56 is sprayed on the top surface. Antimicrobial powder 54 is dropped onto the adhesive layer (to help bind it in place), and then covered with the strengthening substrate material to form the "Step 1 finished roll" that is shown. As illustrated in the second drawing of FIG. 12, the "Step 1 finished roll" produced in step 1 can be further processed by adding a second absorbent core material that is bonded with a hot melt adhesive 56, and then polyethylene and/or polypropylene backing material 58 is added as the finish. The resulting finished roll is removed and converted into a finished cut absorbent body 14 that can be used for transporter 10.

Figure 13:
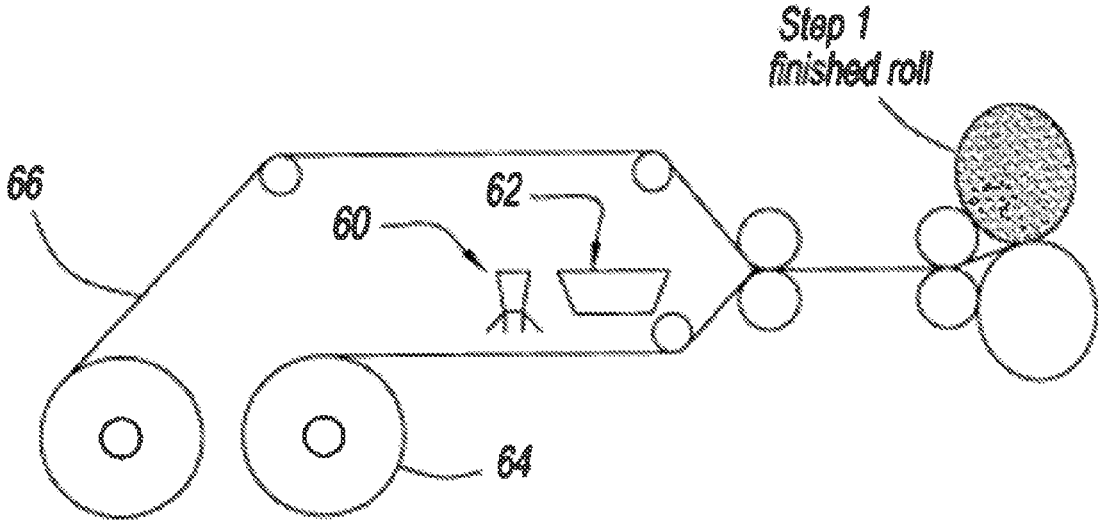
FIG. 13 is a schematic of a process flow to make the base materials of the transporter of FIG. 1, where an antimicrobial is a liquid.

FIG. 13 is a schematic of a different process flow that generally follows the process illustrated in FIG. 12, but uses a liquid antimicrobial instead of an antimicrobial powder. The change from FIG. 12 can be seen in the first step, where antimicrobial liquid spray 60 is used, followed by heat drying 62, which may be accomplished by heated roll segments or a drying oven. Absorbent material 64 and strengthening material 66 are combined as shown to produce the finished roll of material that is used for absorbent body 14 of transporter 10.

Figure 14:
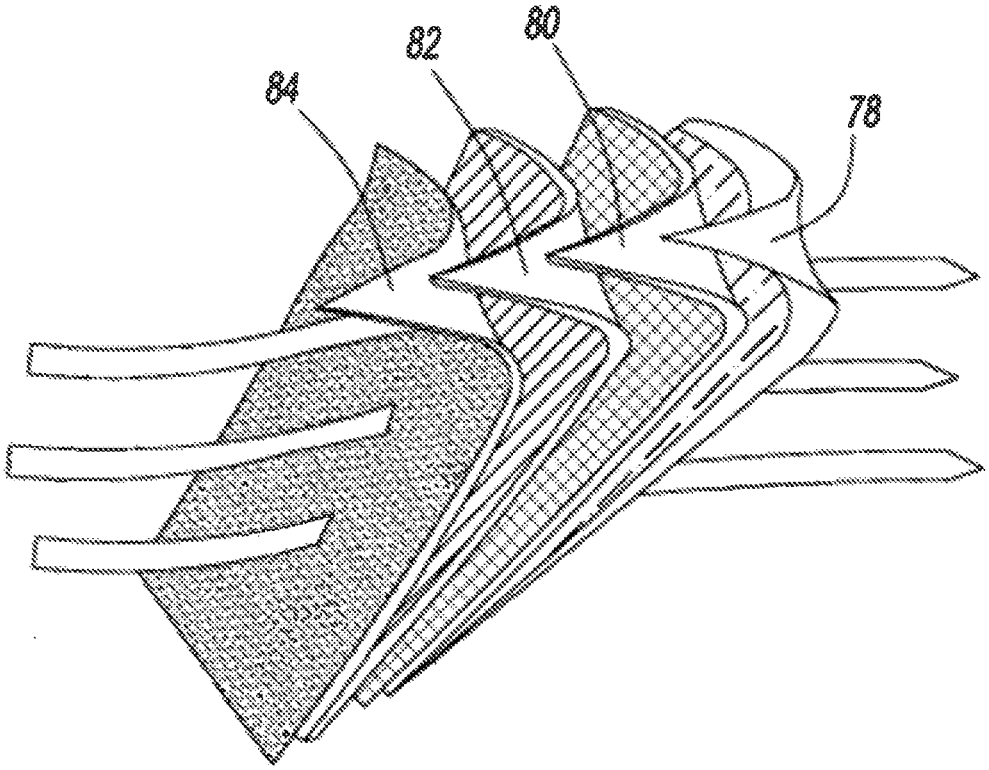
FIG. 14 illustrates layer-by-layer sections of an embodiment of a cover layer of the transporter in FIG. 1.

Referring now to FIG. 14, the layer-by-layer sections of the bottom of an exemplary embodiment of transporter 10 is shown. The outermost layer 78 is made of a polymer, such as polyethylene or polypropylene, and serves as a backing layer. The next inner layer is a bottom absorbent layer 80, which may be of any absorbent or superabsorbent material provided above for absorbent body 14. The next inner layer is a strengthening layer 82, which may be made of materials that include, but are not limited to, non-woven materials, or meltblown or spunlace composites, such as polypropylene non-woven or polypropylene/meltblown non-woven material. The top absorbent layer 84 is closest to the person being carried on top of transporter 10, and may be made of any absorbent or superabsorbent material provided above for absorbent body 14. Top absorbent layer 84 is preferably made of a vapor-permeable material that permits moisture to be "wicked" away from the person's skin surface, such as, but not limited to, polyester, polypropylene, polyethylene, or similar material.

The present disclosure provides a method of using transporter 10 including the following steps. Where, for example, transporter 10 is part of transporter kit 38, transporter 10 is removed from case 40, and transporter 10 is unfolded to its full size. Where the transporter 10 is not part of transporter kit 38, the transporter is simply unfolded to its full size. A person to be carried is positioned on top of transporter 10. One or more other persons acting as carriers then lift transporter 10, and the person positioned thereon, using one or more gripping devices 16, by manually gripping the cutouts or holes, or by inserting rigid bodies 28, such as metal poles, through gripping device 16 and lifting the rigid bodies and transporter 10. The carriers then move transporter 10 and the person thereon for a desired distance.

The method of using transporter 10 may further include securing the patient or soldier to the transporter by securing straps 20, and/or adjusting the tension of the securing straps using buckles 22.

Transporters 10 are well-suited for use for transporting persons in mass-casualty situations, where large numbers of injured, ill, wounded, or dead persons must be moved to a more healthful environment of health care center quickly.

In battlefield situations, injured soldiers or civilians may need to be moved over rugged terrain, in inclement weather, and/or by air or water rescue. In such circumstances, the injured person may be bleeding, or involuntarily evacuating his bowels or bladder. Absorbent body 14 of transporter 10 provides a safer environment for the soldier being carried, as well as preventing contamination of vehicles and any other persons who are being transported in the same vehicle. Absorbent body 14 absorbs most or all of the blood and other body fluids from the injured person, and reduces the likelihood that the person will slip around on transporter 10 or even fall out, which was a danger with conventional litters. Absorption of blood not only makes transportation safer, but adds to the sense of comfort and perception of well-being of the injured person.

Transporters 10 of the present disclosure are also particularly suitable for moving persons who are injured or are ill during natural disasters, such as hurricanes, fires, floods, and earthquakes.

The small storage volumes of transporters 10 and/or transporter kits 38, as well as their light weight, make it feasible to store a large number of such transporters or kits at locations where there are large numbers of people gathered (such as office buildings in large urban areas, hospitals, nursing centers, sports stadiums, and recreation areas), and thus the possibility of mass casualty or mass rescue operations. Transporters 10 are also well-suited for first-response units, such as ambulance teams, firemen, police, Hazmat units, forestry units, and National Guard units. Transporters 10 would be of great utility for carrying mass casualties resulting from natural disasters, such as hurricanes, fires, epidemics, blizzards, and/or flooding, as well as man-made disasters, such as airline crashes, train accidents, terror attacks, and/or large automobile accidents.

Transporters 10 are also particularly well-suited for use in military battlefield situations by medics and front-line troops, to rapidly rescue and transport injured soldiers and civilians, who may have large injuries and who are situated in hostile environments or in rough terrain, where further injury could result from delays in transport.

Other uses for transporters 10 include recreational users, such as hikers, bikers, climbers, boaters, who may be injured far from areas where ambulances can reach, yet the demands of the recreation activity only permit limited equipment and weight that can be carried for emergencies. The small weight/volume of transporters 10, and their compressibility to a size of about 0.019 $m^3$, make such transporters readily portable to the site of recreational activities.

It should be understood that the foregoing description is only illustrative of the present disclosure. Various alternatives and modifications can be devised by those skilled in the art without departing from the disclosure. Accordingly, the present disclosure is intended to embrace all such alternatives, modifications, and variances that fall within the scope of the appended claims.

What is claimed is:

1. A disposable transporter having a top surface for carrying a person, comprising:

a backing substrate having a first side;

an absorbent body secured to said first side of said backing substrate, being sized less than said backing substrate so that a portion of said backing substrate forms an edge about a portion of said absorbent body, wherein said absorbent body is co-planar with said backing substrate and said transporter, and wherein when said person is positioned on said top surface of said transporter, said absorbent body is located directly beneath said person, and contacts only the back portion of said person, to absorb exuded body fluids and thereby acts to dry said person; and a gripping device in said backing substrate that is unencumbered by said absorbent body, wherein the transporter has a weight that is less than 150 grams per square meter ($g/m^2$).

2. The transporter according to claim 1, wherein the transporter is at least eighteen (18) inches in width, at least sixty-five (65) inches in length, and has a total weight of less than 4 pounds, wherein the transporter can carry a person weighing at least 250 pounds.

3. The transporter of claim 2, wherein the transporter is about thirty-three-and-a-half (33.5) inches in width, about seventy-eight (78) inches in length, and has a total weight of less than 3 pounds.

4. The transporter according to claim 1, wherein said backing substrate forms the entire back surface of the transporter.

5. The transporter according to claim 4, wherein said backing substrate extends beyond said absorbent body, and is folded over to form a portion of a top surface of the transporter.

6. The transporter according to claim 1, wherein said backing substrate comprises a material selected from the group consisting of nylon, nylon composite material, strong cloth material, canvas, hemp, flax, cotton fiber materials, polyethylene, polypropylene, polymer films, and any combinations thereof.

7. The transporter according to claim 6, wherein said backing substrate is made of nylon.

8. The transporter according to claim 6, wherein said backing substrate is made of a material selected from the group consisting of polyethylene, polypropylene, and any combinations thereof.

9. The transporter according to claim 1, further comprising an active agent selected from the group consisting of an antimicrobial, bactericide, fungicide, virucide, disinfectant, sanitizer, sterilizer, mildewstat, surfactant, deodorizer, and any combinations thereof.

10. The transporter according to claim 9, wherein said active agent is selected from the group consisting of a metal, metal compound, surface active agent, quaternary ammonium compound, organic acid, inorganic acid, salt, sulfite, biopolymer, synthetic polymer, chitin, chitosan, nisin, enzyme, arginate, diacetate, antioxidant, and any combinations thereof.

11. The transporter according to claim 9, wherein said active agent is on or within said absorbent body.

12. The transporter according to claim 1, wherein said absorbent body further comprises one or more strengthening layers.

13. The transporter according to claim 1, further comprising one or more securing straps.

14. The transporter according to claim 1, wherein said gripping device comprises one or more features selected from the group consisting of hole, strap, eyelet loop, and any combinations thereof.

15. The transporter according to claim 1, wherein said gripping device is two or more gripping devices, and further comprising a rigid body that can be passed through said two or more gripping devices.

16. The transporter according to claim 15, wherein said rigid body is a pole made of a material selected from the group consisting of metal, wood, polymer, and any combinations thereof.

17. The disposable transporter according to claim 1, wherein said transporter is substantially free from any portion substantially perpendicular between said backing substrate and said absorbent body.

18. A kit, comprising:

a disposable transporter according to claim 1; and a water-resistant case for enclosing said transporter, wherein said transporter is foldable to a reduced overall size to fit within said case.

19. A method of using a transporter for carrying a person, comprising:

opening the transporter, wherein the transporter comprises a backing substrate, an absorbent body secured to a top side of said backing substrate, wherein said absorbent body is co-planar with said backing substrate and said transporter, and a gripping device in said backing substrate that is unencumbered by said absorbent body;

positioning said person on said absorbent body and said top side of said backing substrate of said transporter so that said absorbent body is located directly beneath said person, and contacts only the back portion of said person, to absorb exuded body fluids and thereby acts to dry said person; and transporting the person via the transporter;

wherein the transporter is at least eighteen (18) inches in width and at least sixty-five (65) inches in length, and less than 4 pounds in weight; and wherein the transporter can carry a person weighing at least 250 pounds.

* * * * *